US005443178A

United States Patent [19]

Holmes

[11] Patent Number: 5,443,178

[45] Date of Patent: Aug. 22, 1995

[54] TABLET DISPENSING SYSTEM

[75] Inventor: Alix A. Holmes, Costa Mesa, Calif.

[73] Assignee: Allergan, Inc., Irvine, Calif.

[21] Appl. No.: 263,571

[22] Filed: Jun. 23, 1994

[51] Int. Cl.[6] ..... B65D 83/00

[52] U.S. Cl. ..... 221/64; 221/70; 221/96; 221/98; 221/282; 206/390; 206/534.1

[58] Field of Search ..... 206/534.1, 539, 390, 206/820, 216, 39.8; 221/64, 69, 70, 25, 96, 97, 98, 199, 282; 225/106, 103, 42

[56] References Cited

U.S. PATENT DOCUMENTS

| | | | |
|---|---|---|---|
| 149,523 | 4/1874 | Pritchard et al. | 206/39.8 |
| 605,213 | 6/1898 | Weller | 40/310 |
| 845,777 | 3/1907 | Grossman | 215/100 R |
| 1,887,152 | 11/1932 | Geisler | 81/3.4 |
| 2,771,214 | 11/1956 | Lefebvre | 221/25 |
| 3,095,109 | 6/1963 | Exton | 206/216 |
| 3,115,989 | 12/1963 | Strange | 221/25 |
| 4,060,168 | 11/1977 | Romagnoli | 206/216 |
| 4,437,579 | 3/1984 | Obland | 221/25 |
| 4,646,999 | 3/1987 | Clark | 248/360 |
| 4,696,394 | 9/1987 | Estkowski et al. | 206/303 |

FOREIGN PATENT DOCUMENTS

| | | | |
|---|---|---|---|
| 672011 | 10/1963 | Canada | 221/25 |
| 1446223 | 6/1966 | France | 206/820 |

*Primary Examiner*—H. Grant Skaggs
*Attorney, Agent, or Firm*—Walter A. Hackler

[57] ABSTRACT

A tablet dispensing system includes a container and an arcuate housing for containing a supply of tablets. The arcuate housing is configured for being removably attached around a generally cylindrical container and has sufficient length to extend around a majority of the perimeter of the container. The arcuate housing may be shipped in a single circular piece with a perforation therein for separating the arcuate housing and in order to removably dispose same on the cylindrical container. An open end of the arcuate housing is provided for dispensing the tablets therefrom, and a resilient outer wall of the arcuate housing enables one-by-one dispensing of tablets in a carrier therefrom without dispensing of tablets sequentially held in the carrier.

16 Claims, 1 Drawing Sheet

FIG. 1.
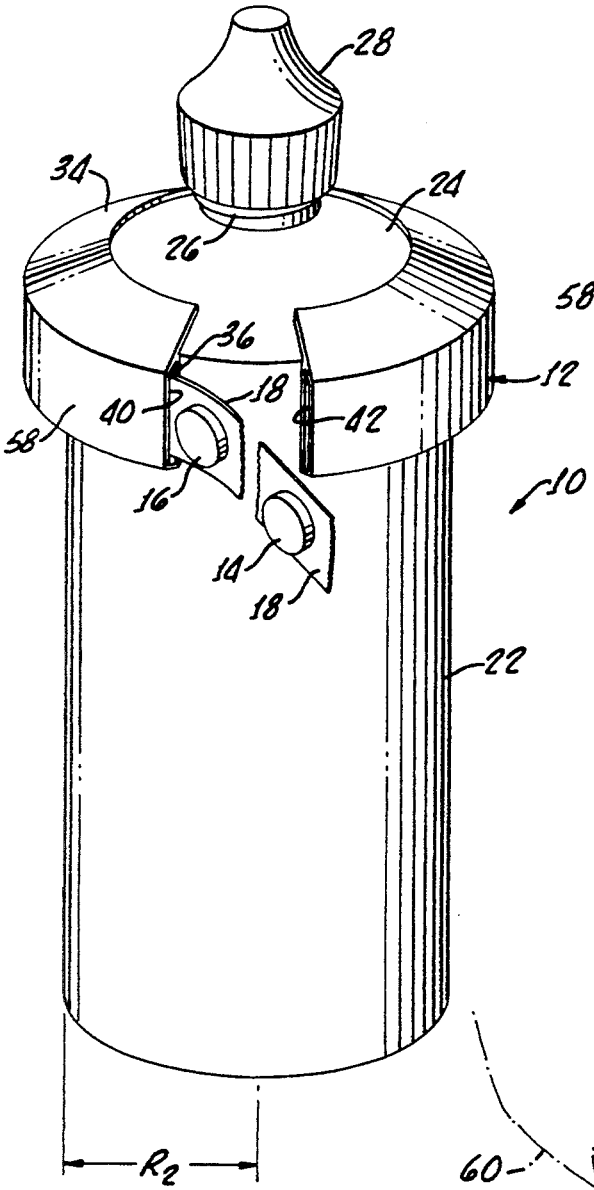
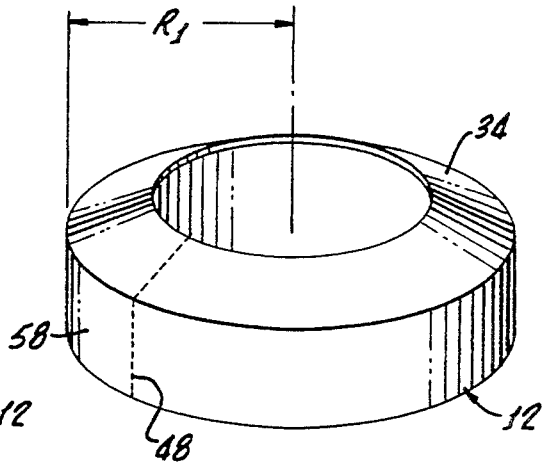
FIG. 2.
FIG. 3.
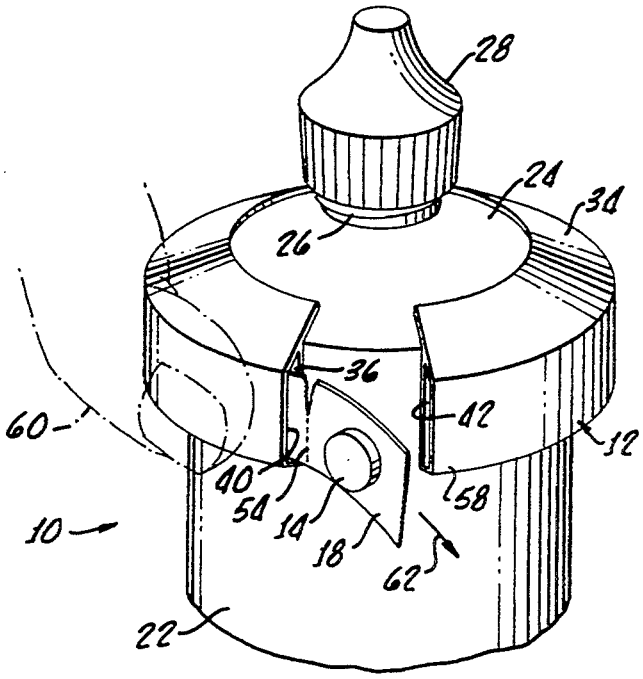

TABLET DISPENSING SYSTEM

The present invention is generally directed to a tablet dispensing system that is more particularly applicable for a lens care product packaging and handling system for facilitating patient use.

The ever-increasing use of contact lenses has naturally brought to the marketplace a great number of solutions that are used in association with the contact lens to make sure that the lenses may be safely, comfortably and conveniently worn.

Packaging for such lens care products which generally include disinfecting compositions, preserving compositions, cleaning compositions, wetting compositions, conditioning compositions and the like are widely varied.

With specific regard to soft contact lenses, proteinaceous materials absorb on the hydrophilic lens surface during typical use.

An effective and safe means for removing such protein build-up-is the use of enzymes. It has been found most convenient to formulate the enzymes as a dry composition, either a powder or a tablet, and to dissolve such material in a saline solution for use in treating the contact lenses.

Thus, many contact lens-treating systems are sold as separate dry and liquid components to be combined and utilized by the user. This configuration naturally presents a packaging and handling problem. It should be apparent that any multiple component system is susceptible to separation of one or more of the components by inadvertent loss by the user which, of course, significantly or completely eliminates the effectiveness of the system for lens treatment. Such occurrences can easily happen when, for example, solid components, such as enzyme tablets or powders, are stored separately from liquid components intended for co-use.

The present invention provides for an easy-to-use tablet dispensing system suitable for lens care regimens, which significantly reduces the possibility of losing a component by enabling physical attachment of a solid dispensing unit with a liquid dispensing unit.

SUMMARY OF THE INVENTION

A tablet dispensing system, in accordance with the present invention, generally includes arcuate housing which provides means for containing a supply of tablets and means for enabling the arcuate housing to be removably attached around a generally cylindrical container. The arcuate housing has sufficient length to extend around a majority of a perimeter of the housing, and means are provided, which define an open end of the arcuate housing, for dispensing the tablets therefrom.

In one embodiment of the present invention, the arcuate housing may be circular and include perforation means for enabling the circular housing to be severed in order to form an arcuate housing having an open end for dispensing the tablets therefrom. Means are also provided for enabling the arcuate housing to be removably attached around a generally cylindrical container with the severed arcuate housing having sufficient length to extend around a majority of a perimeter of the container.

More particularly, in accordance with the present invention, the arcuate housing includes a radially inward-projecting flange for extending over a shoulder of the generally cylindrical container in order to removably attach the arcuate housing around the shoulder. In addition, the arcuate housing includes a hollow chamber disposed beneath the radially inward-projecting flange and in communication with the open end of the arcuate housing for containing and dispensing of the tablets.

Preferably, the arcuate housing is formed from a resilient material and has a radius smaller than a radius of the cylindrical container for causing a compressive fit of the arcuate housing onto the cylindrical container.

More specifically, the tablet dispensing system, in accordance with the present invention, may include carrier means, enclosing the plurality of tablets in a spaced apart relationship, for enabling the tablets to be sequentially pulled from the arcuate hollow chamber. Preferably, the carrier means includes perforations therein, disposed between adjacent tablets for enabling separation of the tablets from one another as each tablet is pulled from the arcuate hollow chamber.

With specific reference to the arcuate hollow chamber, it is preferable to provide compressible outer walls thereof for enabling manual pressure thereon to prevent significant movement of a tablet disposed within the arcuate hollow chamber as an adjacent tablet is removed from the carrier means by separation along a perforation between adjacent tablets.

The tablet dispensing system may further comprise a generally cylindrical container in combination with the arcuate housing hereinabove described.

BRIEF DESCRIPTION OF THE DRAWINGS

The advantages and features of the present invention will be better understood by the following description when considered in conjunction with the accompanying drawings in which:

FIG. 1 is a perspective view of the present invention, generally showing an arcuate housing as it may be disposed on a generally cylindrical bottle;

FIG. 2 is a perspective view of a circular housing, in accordance with the present invention, which may be separated along a perforation thereof to form the arcuate housing, as shown in FIG. 1 disposed about the cylindrical container; and FIG. 3 is a perspective view of the present invention generally illustrating the feature in which the resilient, or pliable, housing wall facilitates removal of a packaged tablet on a one-by-one basis.

DETAILED DESCRIPTION

Turning now to FIG. 1, there is generally shown a tablet dispensing system 10 which generally includes an arcuate housing 12 which provides a means for containing a supply of tablets 14, 16 which may be held in a spaced apart relationship by a carrier 18. The arcuate housing 12 is shown disposed around a generally cylindrical container 22 suitable for holding a liquid, such as saline solution or the like, for use in conjunction with the tablets 14, 16 in a conventional manner as, for example, in the care and treatment of contact lenses (not shown). The container, or bottle, 22 may be formed of any suitable material and generally includes a shoulder 24, terminating at an open end 26, for dispensing fluid and sealed by a removable cap 28.

The arcuate housing 12 may be formed of any suitable resilient material and generally includes a radially inward-projecting flange 34 for extending over the container shoulder 24 in order to removably attach the arcuate housing 12 around the container 22 and shoulder 24.

In addition, an arcuate chamber 36, disposed beneath the radially inward-projecting flange 34 and in communication with an open end 40 of the arcuate housing 12, provides a means for supporting the tablets 14, 16 and carrier within the arcuate housing 12. Another end 42 of the housing may be sealed to prevent removal of tablets 14, 16 therefrom, or open to provide dispensing of tablets from an opposite end (not shown) of the carrier 18.

As shown in FIG. 2, the arcuate housing 12 may be formed as a singular circular unit having a perforation 48 therein to facilitate separation into the arcuate housing 12, as shown in FIG. 1. A radius $R_1$ of the arcuate housing 12, as shown in FIG. 2, is smaller than a radius $R_2$ of the cylindrical container 22 for causing a compressive fit of the arcuate housing 12 onto the cylindrical container 22, as shown in FIG. 1.

The circular configuration of the arcuate housing 12, as shown in FIG. 2, facilitates shipment of the arcuate housing 12 without premature discharge of the tablets 14, 16 therefrom. In addition, the arcuate housing 12 in the circular configuration, as shown in FIG. 2, may be nested upon one another in order to provide a greater supply of tablets 14, 16 for use with the solution provided in the container 22, as may be necessary. In use, one of the arcuate containers 12 may be separated along the perforation 48 and installed on the bottle 22, as shown in FIG. 1, with the remaining containers being stored for future use.

In accordance with the present invention, the tablets 14, 16 may be supported in a spaced apart relationship by a carrier 18 which may be formed from any suitable plastic or paper material. In addition, the perforation 54 may be provided in the carrier 18 between adjacent tablets 14, 16 for facilitating and enabling easy separation of the tablets 14, 16 from one another, as each tablet 14 is pulled from the arcuate hollow chamber 36.

Preferably, the arcuate chamber 36 includes an outer wall 58 which is sufficiently compressible for enabling manual pressure thereon, as shown by a finger 60 in FIG. 3, to prevent significant movement of a tablet 16 disposed within the arcuate hollow chamber 36 as an adjacent tablet 14 is removed from the carrier 18 by separation along the perforations 54, as shown by movement in direction of the arrow 62. Thus, compression of the outer wall 58 against the carrier prevents unwanted discharge or pulling of the carrier 18 with tablets 16 thereon, as the adjacent tablet 14 is removed. Since the tablets 14, 16 project upwardly from the carrier 18, significant pressure onto the carrier 18 by the outer wall 58 is not required. Merely restricting the open end 26 by movement of the outer wall 58 will prevent discharge of the adjacent tablet 16, as the tablet 14 is separated therefrom along the perforations 54 in the carrier 18.

Although there has been hereinabove described a particular arrangement of a tablet dispensing system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A tablet dispensing system comprising:

arcuate housing means for containing a supply of tablets;

means for enabling said arcuate housing means to be removably attached around a generally cylindrical container, said arcuate housing means having sufficient length to extend around a majority, but not all, of a perimeter of said container in order to provide access to said supply of tablets; and means, defining an open end of said arcuate housing means, for dispensing the tablets therefrom.

2. The tablet dispensing system according to claim 1 wherein said means for enabling comprises radially inward projecting flange means for extending over a shoulder of said generally cylindrical container.

3. A tablet dispensing system comprising:

arcuate housing means, having an arcuate hollow chamber, for containing a supply of tablets;

means, defining an open end of said arcuate housing means and communicating with said arcuate hollow chamber, for dispensing the tablets therefrom, radially inward-projecting flange means, disposed over the arcuate hollow chamber and extending over a shoulder of a generally cylindrical container, for enabling said arcuate housing means to be removably attached around said shoulder, said arcuate housing means having sufficient length to extend around a majority of a perimeter of said container.

4. The tablet dispensing system according to claim 3 wherein said arcuate housing means is formed from a resilient material and including means, defining a radius of said arcuate housing means smaller than a radius of the generally cylindrical container, for causing a compressive fit of said arcuate housing means onto said generally cylindrical container.

5. The tablet dispensing system according to claim 4 further comprising carrier means, enclosing said plurality of tablets in a spaced apart relationship, for enabling said tablets to be sequentially pulled from said arcuate hollow chamber, said carrier means comprising means, defining perforations therein, for enabling separation of said tablets from one another as each tablet is pulled from said arcuate hollow chamber.

6. The tablet dispensing system according to claim 5 wherein said arcuate hollow chamber has compressible outer wall means for enabling manual pressure thereon to prevent significant movement of a tablet disposed within the arcuate hollow chamber as an adjacent tablet is removed from said carrier means by separation along a perforation between one tablet disposed within the arcuate hollow chamber and the adjacent tablet.

7. A tablet dispensing system comprising:

circular housing means for containing a supply of tablets;

perforation means for enabling said circular housing to be severed in order to form an arcuate housing having open end means for dispensing the tablets therefrom; and means for enabling said arcuate housing to be removably attached around a generally cylindrical container, said arcuate housing having sufficient length to extend around a majority of a perimeter of said container.

8. The tablet dispensing system according to claim 7 wherein said means for enabling comprises radially inward-projecting flange means for extending over a shoulder of said generally cylindrical container.

9. The tablet dispensing system according to claim 8 wherein said arcuate housing further comprises an arcuate hollow chamber disposed beneath said radially inward-projecting flange means and in communication with the open end of said arcuate housing means.

10. The tablet dispensing system according to claim 9 wherein said arcuate housing means is formed from a resilient material and including means, defining a radius of said arcuate housing means smaller than a radius of the generally cylindrical container, for causing a compressive fit of said arcuate housing means onto said generally cylindrical container.

11. The tablet dispensing system according to claim 10 further comprising carrier means, enclosing said plurality of tablets in a spaced apart relationship, for enabling said tablets to be sequentially pulled from said arcuate hollow chamber, said carrier means comprising means, defining perforations therein, for enabling separation of said tablets from one another as each tablet is pulled from said arcuate hollow chamber.

12. The tablet dispensing system according to claim 11 wherein said arcuate hollow chamber has compressible outer wall means for enabling manual pressure thereon to prevent significant movement of a tablet disposed within the arcuate hollow chamber as an adjacent tablet is removed from said carrier means by separation along a perforation between the tablet disposed within the arcuate hollow chamber and the adjacent tablet.

13. A tablet dispensing system comprising:

a generally cylindrical container;

arcuate housing means, having an arcuate hollow chamber and having sufficient length to extend around a majority of a perimeter of said container, for containing a supply of tablets;

radially inward-projecting flange means, disposed over the arcuate hollow chamber and extending over a shoulder of said generally cylindrical container, for enabling said arcuate housing means to be removably attached around said shoulder; and means, defining an open end of said arcuate housing means and in communication with said arcuate hollow chamber, for dispensing the tablets therefrom.

14. The tablet dispensing system according to claim 13 wherein said arcuate housing means is formed from a resilient material and including means, defining a radius of said arcuate housing means smaller than a radius of the generally cylindrical container, for causing a compressive fit of said arcuate housing means onto said generally cylindrical container.

15. The tablet dispensing system according to claim 14 further comprising carrier means, enclosing said plurality of tablets in a spaced apart relationship, for enabling said tablets to be sequentially pulled from said arcuate hollow chamber, said carrier means comprising means, defining perforations therein, for enabling separation of said tablets from one another as each tablet is pulled from said arcuate hollow chamber.

16. The tablet dispensing system according to claim 15 wherein said arcuate hollow chamber has compressible outer wall means for enabling manual pressure thereon to prevent significant movement of a tablet disposed within the arcuate hollow chamber as an adjacent tablet is removed from said carrier means by separation along a perforation between one tablet disposed within the arcuate hollow chamber and the adjacent tablet.

* * * * *